US005590883A

United States Patent [19]

Brewer

[11] Patent Number: 5,590,883

[45] Date of Patent: Jan. 7, 1997

[54] CRIBBAGE GAME

[76] Inventor: Jeffrey D. Brewer, 11204 SE. Home Ave., Milwaukie, Oreg. 97222

[21] Appl. No.: 491,087

[22] Filed: Jun. 16, 1995

[51] Int. Cl.[6] ..... A63F 3/00

[52] U.S. Cl. ..... 273/249

[58] Field of Search ..... 273/243, 245, 273/249, 287, 148 R, 148 A; 235/90

[56] References Cited

U.S. PATENT DOCUMENTS

| | | | |
|---|---|---|---|
| 2,223,175 | 11/1940 | Ink | 273/243 |
| 2,415,073 | 2/1947 | Buffmire | 273/243 |
| 3,427,027 | 2/1969 | Kenyon | 273/243 |
| 4,598,912 | 7/1986 | Kendrick et al. | 273/245 |
| 4,854,586 | 8/1989 | Morse | 273/249 |
| 4,902,018 | 2/1990 | Morse | 273/249 |
| 5,028,765 | 7/1991 | Hull | 235/90 |

*Primary Examiner*—Benjamin H. Layno

*Attorney, Agent, or Firm*—Marger, Johnson, McCollom & Stolowitz, P.C.

[57] ABSTRACT

An improved cribbage game including in addition to the normal features of the traditional game of cribbage, an additional element of chance in the form of a deck of pegging cards which disrupt the normal course of play when a player's peg lands on predetermined pegging locations.

21 Claims, 1 Drawing Sheet

CRIBBAGE GAME

BACKGROUND OF THE INVENTION

The present invention is directed to an improved cribbage game, and in particular, to an improved cribbage game which includes an additional element of chance.

Cribbage is an ancient game which originated hundreds of years ago, and which remains very popular today. The traditional game of cribbage is played using standard playing cards and a peg board. The peg board typically has parallel tracks of holes and pegs which are inserted into the holes to tally points as play proceeds. A hand of cribbage is divided into two phases: pegging and counting. Points are awarded during pegging when cards are played in particular sequences. After each player has played all their cards, pegging is completed. Additional points are then awarded to each player if they can form particular card combinations from cards in their hand.

Cribbage includes significant elements of chance based upon the cards dealt to each player, and the starter card drawn. It also requires a high level of skill to understand the possible point combinations and odds available to each player, and to maximize a player chance of winning based on choosing the best available offensive and defensive strategies presented in each hand.

The present invention provides an improved game of cribbage which incorporates the rules, strategy, and chance elements of the traditional game of cribbage, and will also introduces a significant additional element of chance.

SUMMARY OF THE INVENTION

The present invention introduces an additional element of chance into the traditional game of cribbage by including, in addition to the normal deck of playing cards, a deck of "peg cards". The peg cards are brought into play when a player's peg lands on predetermined pegging positions located at intervals along the scoring tracks. Each peg card initiates a play which changes one or more cards in a player's hand, changes the starter card, moves a player's peg backward a specified number of spaces, or changes the point value or possession of the crib. The peg cards thereby disrupt the normal course of play, and introduce significant new elements of chance and strategic considerations into the traditional game of cribbage.

The foregoing and other objects, features and advantages of the invention will become more readily apparent from the following detailed description which proceeds with reference to the drawings.

DETAILED DESCRIPTION OF THE PREFERRED EMBODIMENT

Figure 1:
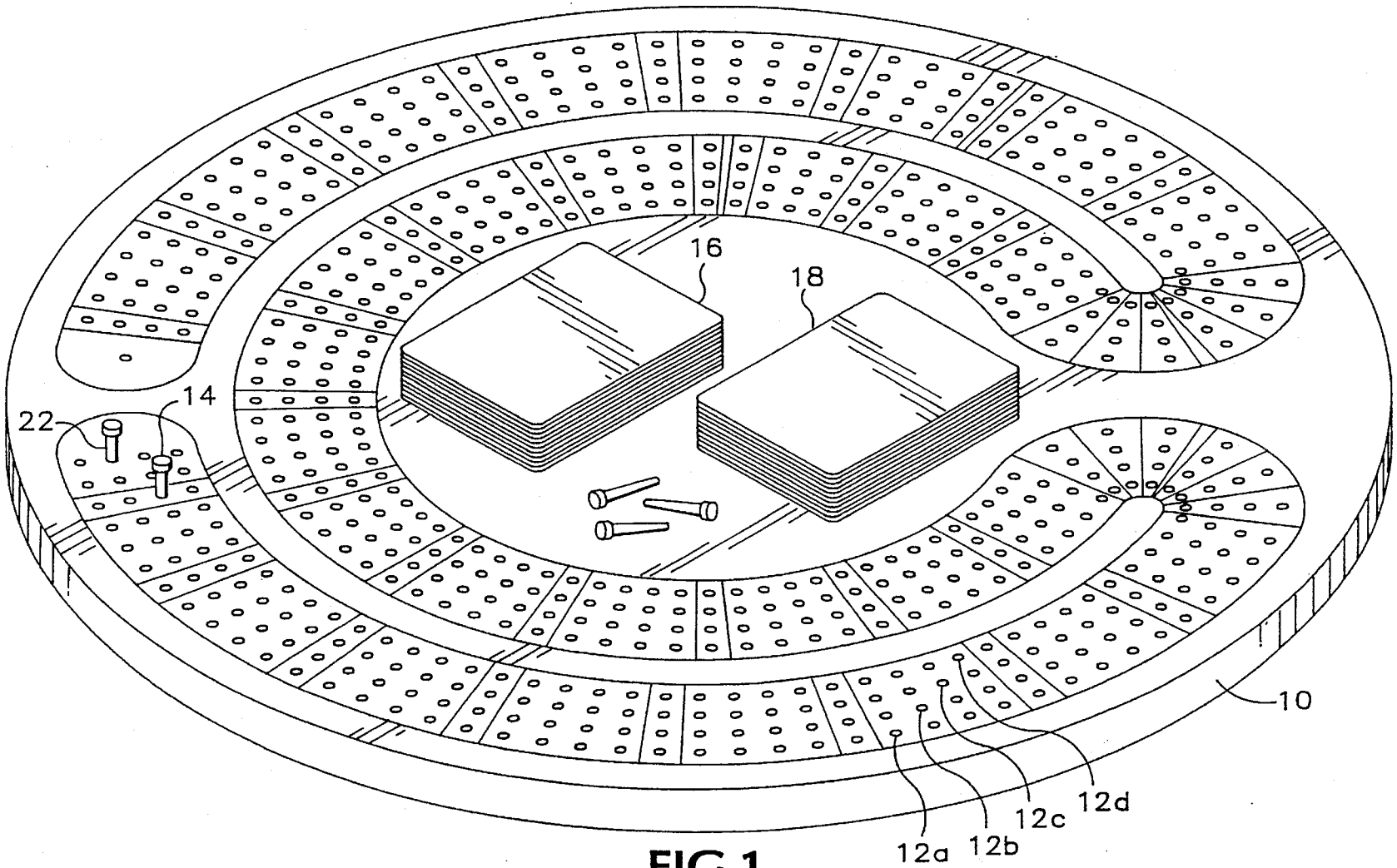
FIG. 1 is a perspective view of a cribbage board and cards according to the present invention.

Referring now to FIG. 1, a cribbage board according to the present invention is shown at 10. Board 10 includes 4 parallel scoring tracks 12*a–d*. Each scoring track includes 161 holes formed in the board. Alternative embodiments could have more or less than four scoring tracks, and each scoring track could have more or less than the 161 holes. The holes are sized to receive pegs 14, which are used by each player to tally their points during play. A standard deck of playing cards having the four suits of spades, hearts, clubs and diamonds, and each suit having ace through king, is shown at 16. A deck of peg cards is shown at 18.

Each scoring track includes multiple "peg card holes" 20, identified as such by a surrounding contrasting color or pattern, or otherwise visually distinguished from the remaining holes. A player landing on a peg card hole is required to draw a card from the peg card deck 18, and to follow the direction printed on the drawn peg card. In the preferred embodiment, the peg card deck includes the specified numbers of the following cards:

six Go-Back cards which direct the player drawing the card to move their pegs backwards along the scoring track 10, 10, 9, 7, 5, and 5 spaces respectively. If moving their peg backwards as directed by a Go-Back card results in the player landing on another peg card space, the player must then draw another peg card and follow the instructions thereon. The drawing of a Go-Back card restarts the pegging count at zero;

six Starter-Cards, including a jack, 8, 7, two—5's, and a 4; When a Starter-Card is drawn from the peg card deck it replaces the starter card which had been cut from the playing deck at the beginning of the hand. The suit becomes wild. If a player has a jack in their hand, they may count the jack to score a Nob, during scoring-of-the-hands. The Starter-Card does not start the pegging count over;

three Trade cards; A player drawing a Trade-Card must trade one card from their hand with one card from any other player's hand. The card selected from the other player's hand may be a card already played during pegging, or may be an unplayed card remaining in the other player's hand. As soon as a card has been traded it is laid down as if already played during pegging. Drawing a Trade-Card restarts the pegging count;

three Switch-Cards; When a Switch-Card is drawn, each player, starting with the drawing player, must switch one card from their hand with one card from a player's hand to their right or left as directed by the Switch-Card. No player may choose a card that has already been switched. As with a Trade-Card, the switched card may be one which has been played during pegging, or may be an unplayed card remaining in another player's hand. As soon as a card is obtained as part of a switch it is laid down as if already played during pegging. Drawing a Switch-Card restarts the pegging count;

two Block-Cards; A Block-Card may be used to block any trade directed by another peg card. The Block-Card may only be used once, and must then be returned to the bottom of the peg card deck. The player blocked must then trade with a different player if more than two players are playing. If there are only two players, the block card cancels the trade card. The player attempting to use the Trade-Card can choose to use or keep their Trade-Card for later use.

three Send-Back Cards designated 7, 8, and 10 spaces respectively; A player who draws a Send-Back Card may send another player back the number of spaces specified on the Send-Back Card. Drawing a Send-Back Card restarts the pegging count;

three CRIB-B-GONE Cards—A player who draws a CRIB-B-GONE CARD takes possession of the CRIB and scores the points as their own if the player retains possession of the crib until the pegging is completed. If the CRIB already belongs to the player or to another player of the same team, the player or team scores double the CRIB score. Drawing a CRIB-B-GONE Card does not change the rotation of the deal, although the CRIB is still counted last. Drawing a CRIB-B-GONE Card does not restart start the pegging count.

PLAYING THE GAME

The fundamentals of the improved cribbage game according to the present invention are similar in many ways to that of the traditional game of cribbage. The game may be played with 2, 3, or 4 single players, or 4, 6, or 8 players paired as teams of two. Each scoring track totals 161 points, and play ends when a player or team scores 161 points.

To begin play, each player or team places two matching pegs in the start spaces 22 and 24 of their scoring track. The PEG CARD deck 18 is shuffled and placed on the game board in the center. The standard card deck is shuffled, after which each player cuts a card from the deck. The player cutting the lowest card wins the first deal. Aces are always low. The deal rotates clockwise in subsequent hands.

The dealer reshuffles the standard deck, and deals as follows:

with 2 players—6 cards are dealt to each player, and each player discards two cards facedown to the crib for counting after pegging play is completed;

with 3 players—5 cards are dealt to each player, one card is dealt to the crib, and each player discards one card to the crib;

with 4 players—5 cards are dealt to each player, and each player discards one card to the crib;

with 6 players—5 cards are dealt to each player; the players making up the dealer's team discard one card each to the "dead" pile; the other players each discard one card each to the crib;

with 8 players—5 cards are dealt to each player; the players making up the dealer's team and the team of the player to the dealer's right discard one card each to the dead pile; the players making up the remaining teams discard one card each to the crib.

After the dealer has completed dealing, and after all the players have discarded, the player on the dealer's right cuts and turns up a Starter Card from the standard deck. If the starter card is a Jack, the dealer immediately pegs 2 points. The player on the dealer's left then lays one card face up and announces the card value. Play continues to the left, each player in turn playing a single card and announcing the cumulative total of the cards played. If a player plays a card which causes the pegging total to reach exactly 15, the player scores 2 points. A player scores two points for playing a card which matches the previously played card, three points for a run of three, and so on according to traditional rules of cribbage. Any player landing; on a peg hole at any time during pegging play picks the top card from the pegging deck, and play proceeds according to the instruction on the drawn pegging card as described above. Play then continues clockwise with each player playing one card in turn until a player is unable to play without exceeding 31. That player must then announce "GO", and play bypasses the player. Play continues until no players are able to lay an additional card without exceeding 31, whereupon the last player to have played a card scores one point. A player may continue to play in succession if no one else is able to play. The last player able to play a card without exceeding 31 pegs one point for the "GO". If a player plays a card which causes the pegging count to hit exactly 31, the player scores two points. Pegging play then restarts with the person left of the player who scored the "GO".

After all the cards have been played, each player, starting with the player to the left of the dealer, scores their hand, including the starter card, as follows:

one point for the jack of the same suit as the starter card;

two points for each combination of cards that total fifteen (e.g. 7+8=15 or J+5=15)

two points for each pair;

three points for a run of three cards in consecutive order (e.g. A–2–3;=3 points or 10–J–Q–K=4 points or K–10–J–9–Q=5 points).

four points for a run of four cards in consecutive order;

four points if all four cards in the player's hand are the same suit; if the starter card is the same suit as all four cards in the player's hand, the player may score one additional point for that card also; five points is scored for a flush for the crib, which requires that all four cards in the crib and the starter card be of the same suit;

five points for a run of five cards, necessarily including the starter card;

six points for three-of-a-kind;

eight points for a double run of three cards (e.g. A–2–2–3, or J–Q—Q–K);

ten points for a double run of four cards (e.g. 10–J–Q–Q–K);

twelve points for four of a kind;

fifteen points for a triple run of three cards (e.g. J–Q—Q—Q–K); and sixteen points for a double double run of three cards (e.g. 5–6—6–7—7).

After all the players have scored their hands, the player to the dealer's left reshuffles and deals the next hand. The first player or team to score 161 points wins the game.

Having illustrated and described the principles of the invention by way of a preferred embodiment, it should be readily apparent to those skilled in the art that the invention can be modified in arrangement and detail without departing from such principles. For example, different combinations and/or numbers of pegging cards could be employed. The number or spacing of peg-card holes could also be varied. I claim all modifications coming within the spirit and scope of the accompanying claims.

What is claimed is:

1. A combination of playing cards and a playing board for playing an improved game of cribbage comprising:

a game board having a plurality of predetermined positions defining parallel scoring tracks, said plurality of predetermined positions including a plurality of peg card positions having indicia distinguishing said peg card positions from the remainder of said plurality of predetermined positions;

game pieces for marking each player's progress along the scoring tracks;

a deck of playing cards including four suits of cards including spades, hearts, diamonds and clubs, each suit including an ace having a value of one point, two through ten each having a point value equal to their face value, and a jack, queen, and king each having a value of 10 points; and a deck of peg cards, each peg card bearing a specified change to the course of play which introduces an additional chance element into the game.

2. The combination of claim 1 wherein the deck of peg cards includes at least one back-space card which directs a player to move their game piece backwards along a scoring track.

3. The combination of claim 1 wherein the deck of peg cards includes at least one trade card directing a player to trade at least one card from their hand with at least one card from another player's hand.

4. The combination of claim 1 wherein the deck of peg cards includes at least one card which allows a player to block a trade initiated by a player who has drawn a trade card.

5. The combination of claim 1 wherein the deck of peg cards includes at least one card requiring that a previously identified starter card be replaced with a different starter card.

6. The combination of claim 1 wherein the deck of peg cards includes at least one card which instructs all players to switch at least one card with another player.

7. The combination of claim 1 wherein the deck of peg cards includes at least one card which changes the value of the crib to a player.

8. The combination of claim 7 wherein the deck of peg cards includes at least one card which changes the player to whom the point value of the crib is awarded.

9. The combination of claim 7 wherein the deck of peg cards includes at least one card which changes the point value of the crib.

10. The combination of claim 1 wherein the peg card positions are spaced apart along the parallel tracks.

11. The combination of claim 1 wherein the peg card positions are spaced apart along the parallel tracks at regular intervals.

12. The combination of claim 1 wherein the peg card positions are located at intervals of five spaces.

13. The combination of claim 1 wherein the deck of peg cards includes at least one back-space card instructing one or more players to move their game piece back a specified number of spaces, at least one trade card directing a player to trade at least one card from their hand with at least one card from another player's hand, at least one card which allows a player to block a trade initiated by a player who has drawn a trade card, at least one card requiring that a previously identified starter card be replaced with a different starter card, at least one card which instructs all players to switch at least one card with another player, at least one card which changes the value of the crib to a player, and at least one card which changes the point value of the crib.

14. A method of playing an improved game of cribbage comprising the steps of:

providing a playing board having a plurality of predetermined positions defining parallel scoring tracks, said plurality of predetermined positions including a plurality of peg card positions having indicia distinguishing said peg card positions from the remainder of said plurality of predetermined positions; game pieces for marking each player's progress along the scoring tracks; a deck of playing cards including four suits of cards including spades, hearts, diamonds and clubs, each suit including an ace having a value of one point, two through ten each having a point value equal to their face value, and a jack, queen, and king each having a value of 10 points; and a deck of peg cards, each peg card bearing a specified change to the course of play which introduces an additional chance element into the game;

dealing each player a hand of at least four cards from the deck of playing cards;

forming a crib of four cards from the deck of playing cards;

cutting a starter card from the deck of playing cards;

sequentially playing cards from each player's hand;

moving each player's game pieces along the respective scoring tracks in accordance with points scoring during play;

drawing a peg card when scoring results in a game piece falling on a peg card position;

tallying a counting value of each player's hand and the crib; and continuing play until a player has accumulated a winning number of points.

15. The method of claim 14 wherein the step of conforming play to an instruction on the drawn peg card includes moving a player's game piece backwards along a scoring track.

16. The method of claim 14 wherein the step of conforming play to an instruction on the drawn peg card includes a player switching at least one card from their hand with at least one card from another player's hand.

17. The method of claim 16 wherein the step of conforming play to an instruction on the drawn peg card includes blocking a switch initiated by the step of drawing a trade card.

18. The method of claim 14 wherein the step of conforming play to an instruction on the drawn peg card includes changing the previously identified starter card to a different starter card.

19. The method of claim 14 wherein the step of conforming play to an instruction on the drawn peg card includes each players switching at least one card with another player.

20. The method of claim 14 wherein the step of conforming play to an instruction on the drawn peg card includes changing the value of the crib to a player.

21. The method of claim 20 wherein the step of conforming play to an instruction on the drawn peg card includes changing the player designated to receive a point value of the crib.

* * * * *